US005239348A

United States Patent [19]

Fukuchi et al.

[11] Patent Number: 5,239,348

[45] Date of Patent: Aug. 24, 1993

[54] COLOR IMAGE FORMING APPARATUS

[75] Inventors: Masakazu Fukuchi, Hachioji; Shizuo Morita, Tachikawa; Satoshi Haneda, Hachioji; Hisao Satoh, Hachioji; Tadayoshi Ikeda, Hachioji, all of Japan

[73] Assignee: Konica Corporation, Tokyo, Japan

[21] Appl. No.: 757,271

[22] Filed: Sep. 10, 1991

[30] Foreign Application Priority Data

Sep. 13, 1990 [JP] Japan ..... 2-244975
Sep. 13, 1990 [JP] Japan ..... 2-244977

[51] Int. Cl.[5] ..... G03G 15/20
[52] U.S. Cl. ..... 355/282; 355/321
[58] Field of Search ..... 355/282, 285, 308, 309, 355/318, 321; 219/216; 271/278

[56] References Cited

U.S. PATENT DOCUMENTS 4,791,447 12/1988 Jacobs ..... 355/290
4,855,787 8/1989 Hashimoto et al. ..... 355/311
4,908,673 3/1990 Muramatsu ..... 355/311
4,972,206 11/1990 Matousheu ..... 355/285 X

FOREIGN PATENT DOCUMENTS 2-141767 5/1990 Japan .

*Primary Examiner*—Leo P. Picard
*Assistant Examiner*—Christopher Horgan
*Attorney, Agent, or Firm*—Finnegan, Henderson, Farabow, Garrett & Dunner

[57] ABSTRACT

A color image forming apparatus including an image carrying member on which a toner image is formed, a transferring device to transfer the toner image onto a recording sheet, a conveyer to convey the sheet on which the toner image has been transferred, a fixing device to fix the toner image on the sheet and a storage device to store the transfer sheet which has been fixed once by the fixing device. The storage device can feed the stored transfer sheet to the fixing device in order for it to be fixed a second time, and can be detachably mounted to the apparatus.

19 Claims, 10 Drawing Sheets

COLOR IMAGE FORMING APPARATUS

BACKGROUND OF THE INVENTION

This invention relates to a color image forming apparatus which forms a toner image on an image carrying member by electrophotography and transfers it onto a recording sheet to obtain a color image, and more particularly, to a color image forming apparatus such as a printer, a copier or a facsimile capable of forming a color image with excellent color reproducibility onto a recording sheet such as OHP film (transparent film for overhead projector: synthetic resin recording sheet).

In the conventional color image forming apparatus, when a color image is formed on a recording sheet or particularly, thick paper or OHP film, it is necessary to melt the toner almost completely and smooth the toner surface by eliminating roughness, thus fixing conditions are changed each time a color toner image is fixed.

As a method to change fixing conditions, a method to change fixing temperature and a method to change fixing speed are available. The former method to change fixing temperature has the following problems; (1) It takes a long time to reach a specified temperature, (2) an offset due to a temperature change is likely to occur, further (3) color reproduction is insufficient by only raising temperature. On the other hand, the problems of the latter method in which the fixing speed is changed are that the distance from a transfer means to a fixing means needs to be longer than the length of a recording sheet, and that the fixing speed can not be reduced only to the extent that the trailing edge of a preceding recording sheet does not overlap the loading edge of a following recording sheet at the time of continuous image forming.

Anyhow, it is difficult to obtain a color image with excellent color reproducibility in image forming by methods to change fixing temperature or speed.

Considering these problems, the applicant has proposed a color image forming apparatus capable of obtaining a color image with excellent color reproducibility by transferring a recording sheet which has been fixed once to be fixed again by means of a recording sheet carrying means, in Japanese Patent Laid Open No. 2-141767.

However, because the image forming apparatus disclosed in the Japanese Patent fixes an image twice by means of the fixing means by means of a guide pawl, it has such problems that the structure is complicated and the unit size cannot help but become enlarged.

SUMMARY OF THE INVENTION

An object of the present invention is to provide a compact color image forming apparatus with a simple mechanism, capable of fixing a second time a recording sheet which has been once fixed by means of a fixing means. Another object of the present invention is to provide a color image forming apparatus equipped with a refixing mechanism capable of improving gloss, optical transmission and fixing performance in case a color image or OHP film is fixed insufficiently.

The first composition of the color image forming apparatus of the present invention comprises a transfer means to transfer a toner image on photoreceptor to a recording sheet, a carrying means to carry the recording sheet, a fixing means to fix the toner image on the recording sheet carried by the carrying means, and a detachable recording sheet storage means to store the recording sheet fixed once by the fixing means and feed the recording sheet to the fixing means to refix the recording sheet.

The second composition of this apparatus comprises a fixing means to fix a toner image on a recording sheet, a paper delivery means to deliver the recording sheet from the apparatus, a movable storage means to store the recording sheet delivered by the paper delivery means when it is located at the first position and a refixing feed means to feed the recording sheet stored in the storage means to the fixing means to refix the recording sheet when the storage means is located at the second position.

DESCRIPTION OF THE PREFERRED EMBODIMENTS

The present invention is explained below according to the first embodiment represented on the attached drawing.

Figure 1:
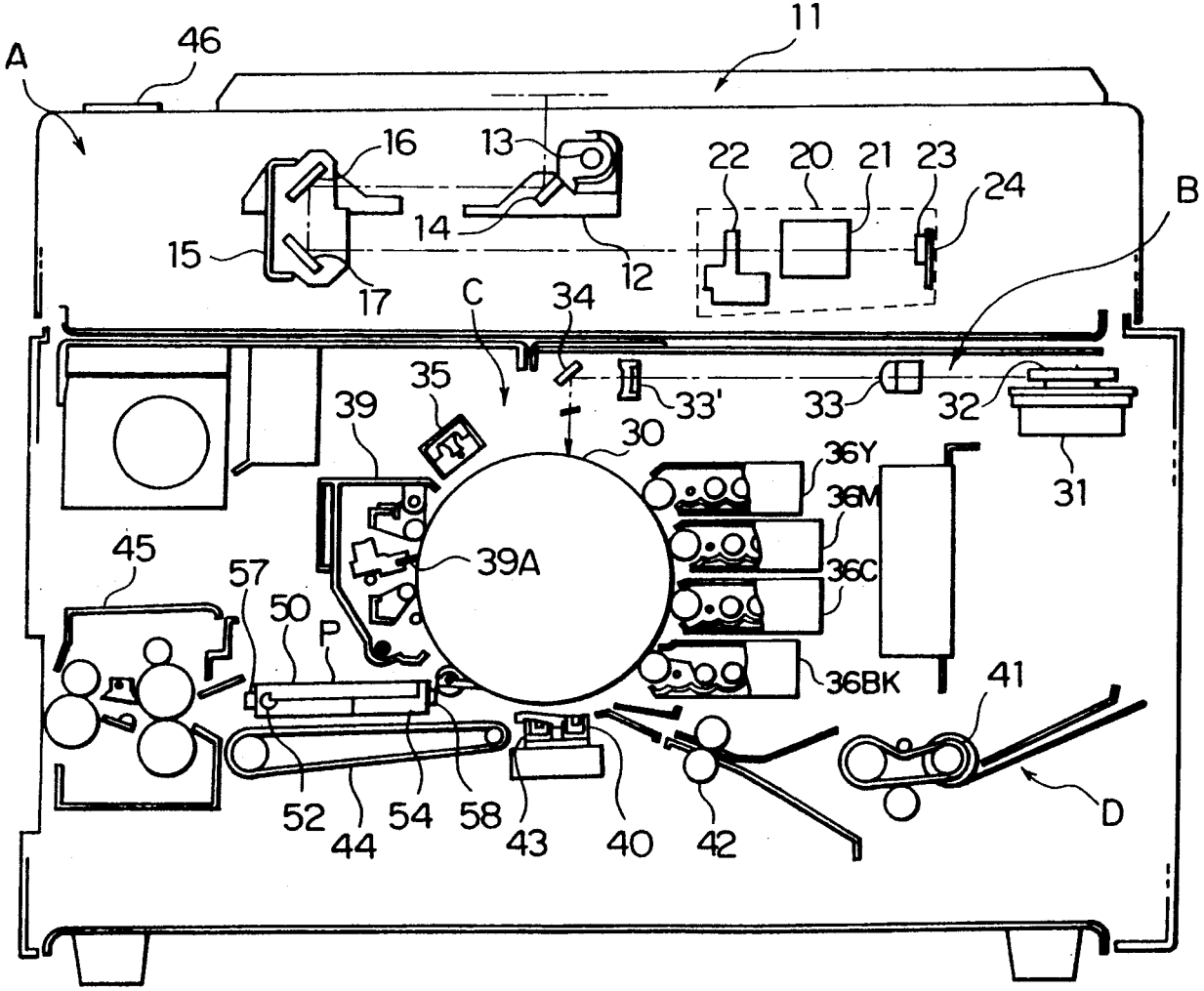
FIG. 1 is a major sectional view of a color copier to which the present invention is applied.

FIG. 1 represents the major configuration of a color copier which is a color image recording apparatus. This color copier comprises an image read system A, a laser write system B, an image forming member C and paper feeder D, and a color image is formed through the following process.

In the above mentioned read system A, an original stored in the platen 11 is exposed by a halogen lamp 13 mounted on the carriage 12 which slides horizontally. The movable mirror unit 15 is equipped with the mirrors 16 and 17, and slides horizontally also to reflect an optical image of an original to the lens reading member 20 in combination with the mirror 14 attached to the carriage 12.

The carriage 12 and movable mirror unit 15 are driven through a wire connected to a stepping motor (not shown here) and slide at the speed V and ½ V respectively in the same direction.

The lens reading member 20 contains the lens 21, CCD 23 at a focusing position in the back and a filter 22 controlled by a CPU moves in a perpendicular direction to the paper surface. The filter 22 is used for color separation when reading an original on the platen 11, and contains filters allowing red, green and blue lights to pass and a neutral filter allowing all three color lights to pass. To make the red, green and blue filters correspond to development by cyan (C) toner, magenta (M) toner and yellow (Y) toner respectively, the CPU dispatches a command to set an appropriate filter by means of a filter selection circuit. The neutral filter is made to correspond to development by black (BK) toner.

A corrected color signal depending on the toner color is entered into the laser write system unit, an exposure means.

A laser beam generated by the semiconductor laser (not shown) in the laser write system unit B is reflected by the polygon mirror 32 which is rotated by the drive motor 31, transmitted through the "f$\theta$" lens 33 and cylindrical lens 33', then reflected by the mirror 34 and projected on the surface of an image carrying member 30 charged equally with a specified electric charge by the charger 35 which is a charging means.

On the other hand, concerning the secondary scanning direction, an index set at a specified position of the image carrying member 30 is detected by a photosensor (not shown) and a print instruction signal is received. Modulation of semiconductor laser by an image signal is started according to this detection or instruction signal so as to determine the primary scanning direction. Concerning the primary scanning direction, when scanning starts, the laser beam is detected by the index sensor (not shown) and according to this detected signal, modulation of semiconductor laser by the image signal of the first color starts so that a modulated laser beam is run on the surface of the image carrying member 30. Consequently, a latent image corresponding to the first color is formed on the surface of the image carrying member by the primary scanning by laser beam and secondary scanning by a rotation of the image carrying member 30. This latent image is developed by the developing device 36Y loaded with yellow toner, for example, of the multiple developing means provided in parallel in this embodiment so as to form a toner image on the surface of the drum. An obtained toner image passes under the cleaning device 39 which is a cleaning means separated from the surface of the image carrying member 30 while being held on the drum surface and the next copy cycle is started.

That is, the image carrying member 30 where a yellow toner image was formed is recharged by the charger 35 and then the image signal of the second color output from the signal processing member is input into the laser write system B, so that it is written onto the drum surface like the image signal of the first color to form a latent image. This latent image is developed as the second color by means of the developing device 36M loaded with magenta toner, for example. This magenta toner image is formed on the already formed yellow toner image.

Likewise, a latent image formed by the image signal of the third color output from the signal processing member is developed by the developing device 36C containing cyan toner so as to form a cyan toner image and further, a latent image formed by the image signal of the fourth color is developed by the developing device 36BK containing black toner and then a black toner image is put over the already formed images on the drum surface, so that a color toner image is formed on the surface of the image carrying member 30.

The developing sleeves of these developing devices 36Y, 36M, 36C and 36BK are charged with DC or AC bias so as to conduct reversal (jumping) development on the image carrying member 30 whose base is grounded. Either one-component developer or two-component developer can be utilized for this non-contact development. However, the method using two-component developer produces a better stability of developing for reproduction of color.

A color image formed on the surface of the image carrying member 30 as mentioned above is supplied from the paper feeder D by means of the paper feeding belt 41 in the transfer device 40 provided as a transfer means and transferred onto a recording sheet by the timing roller 42 by aligning the timing with the color image. Then, the transfer device 40 is charged with a high voltage with an opposite polarity to toner to transfer an image. After a color toner image has been transferred, the recording sheet is separated from the drum surface by means of the separating device 43, carried to the fixing device 45 through the transfer belt 44 so as to fix an image and then discharged.

On the other hand, after the recording sheet is separated from the drum surface, the blade 39A of the cleaning device 39 is in a firm contact with the image carrying member 30 to remove remaining toner, and after the removal is terminated, it leaves the drum surface and enters a new color image forming process.

Meanwhile, in the color copier having the configuration mentioned above, the transfer speed of a recording sheet by the paper feeding belt 41, timing roller 42, image carrying member 30 and transfer belt 44, and the fixing speed of the fixing device 45 are all 120 mm/sec, and the fixing temperature of the fixing device 42 is 160° C.

Figure 2:
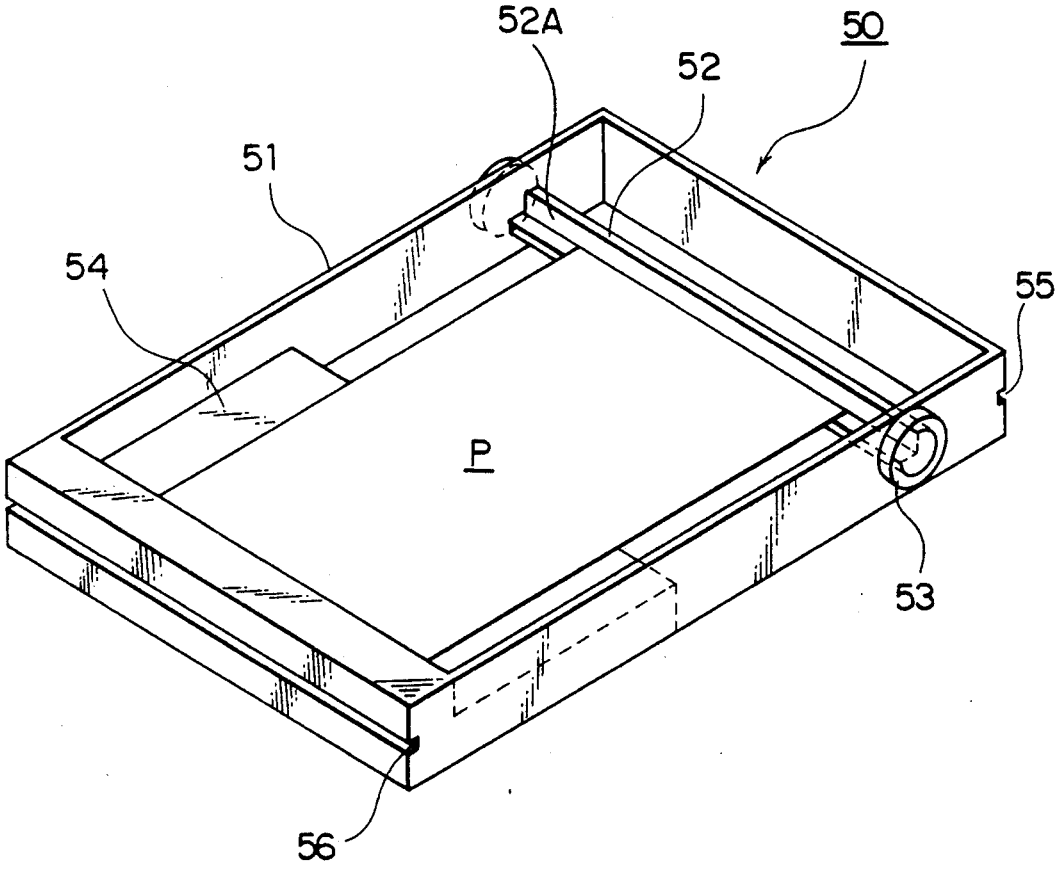
FIG. 2 is a cassette for refixing capable of storing a piece of recording sheet.

As a recording sheet storage means, the cassette for refixing 50 is provided so as to be detachable above the transfer belt 44 of the above mentioned color copier. As shown in FIG. 2, the cassette for refixing is provided with a movable section 52, rotatable in the frame 51 and both ends of the movable section 52 protruding from the frame 51 have a rotating member 53 which rotates together with the movable section. The fastener 54 is set on the frame 51.

For the cassette for refixing to be attachable or detachable, the cassette for refixing 50 is provided with the indented sections 55 and 56, and the main unit is provided with guide members 57 and 58 having protrusions corresponding to the indented sections 55 and 56.

Forming a color image on a recording sheet such as OHP film or thick paper using the above mentioned color copier is explained below.

First, an image is formed on a recording sheet in the ordinary mode mentioned previously and the sheet is discharged outside.

Then, a recording sheet P fixed once is laid in the cassette for refixing, spanning between the cutout 52A provided on the movable section 52 of the cassette for refixing and fastener 54. The indented sections 55 and 56 along the guide members 57 and 58 provided on the main unit, and the cassette for refixing 50 is inserted into the main unit, for example, from the front of the main unit. Then, by rotating the rotating member 53, the movable section 52 is rotated so as to drop the end of a recording sheet P placed on the cutout 52A onto the transfer belt 44.

Figure 3:
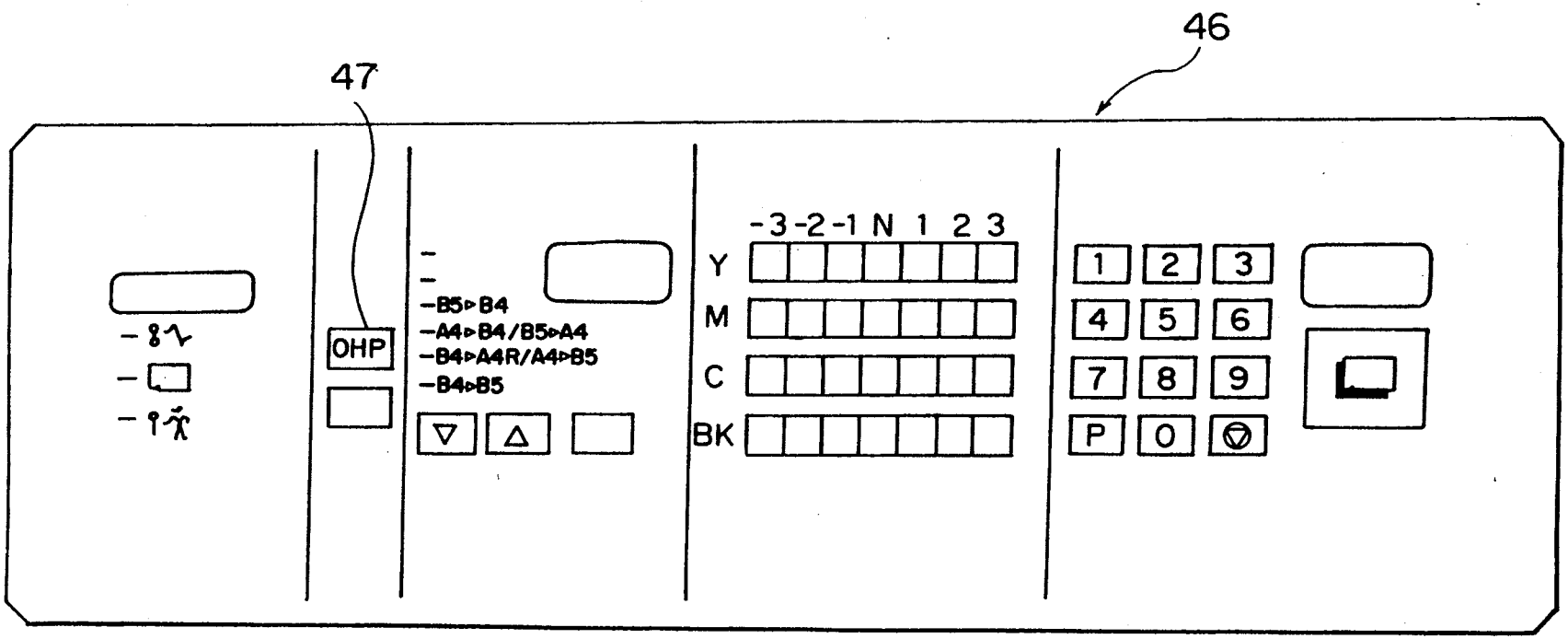
FIG. 3 is a view indicating the control panel.
Figure 4:
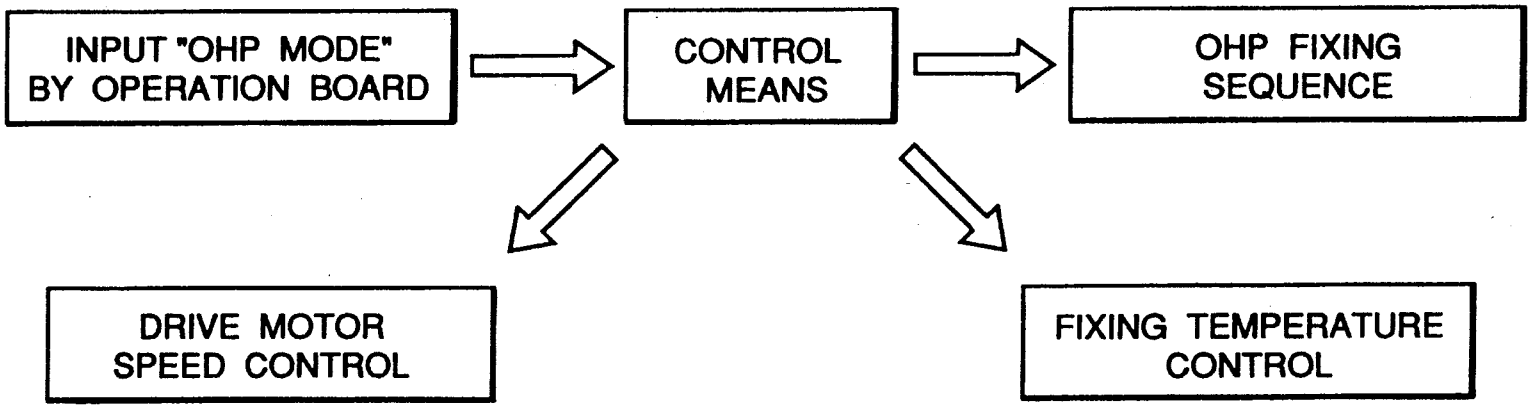
FIG. 4 is a view indicating a control means by refixing mode.

On the other hand, the OHP button 47 on the control panel is pressed. (See FIG. 3) When this button is pressed, OHP mode is input into the control means as shown in FIG. 4 and drive motor speed control signal and fixing temperature control signal are output so as to reduce the transfer speed of the transfer belt 44 and the fixing speed of the fixing device 45 compared with the speed of normal mode, for example, from 120 mm/sec to 30 mm/sec, and raise the fixing temperature of the fixing device 45 by between 10° C. to 40° C. higher than normal mode, for example, from 160° C. to 180° C.

When the fixing temperature of the fixing device reaches 180° C., the drive motor rotates at the carrying speed mentioned previously according to an OHP fixing sequence so as to drive the carrying belt 44 and fixing device 45, pulling the end of the recording sheet P which has dropped on the carrying belt 44 up to the fixing device 45, where images are refixed.

Meanwhile, when OHP mode is selected, the image read system A, laser write B, image forming device C and paper feeder D, except the carrying belt 44 and fixing device 45, are kept inactive. That is, no image is formed at the time of refixing; means necessary for forming images are kept inactive, so that only the carrying belt necessary for refixing and the fixing device 45 are actuated.

The toner to be used for a color copier of this embodiment contains polyester resin mixed with dye and pigment, which is smashed to the average weight grain diameter of 3 through 12 μm, having a softening point of about 140° C.

Further, the fixing device 45 comprises a heat roller, which is made of an aluminum core metal coated with fluorine contained resin, having a diameter of about 30 mm, a pressure roller, which is made of an iron core metal coated with silicon rubber, having a diameter of about 30 mm and halogen lamp of 600 W for heating. The total pressure by a pair of rollers of the fixing device 45 is 17 kg over 30 mm. However, the present invention is not always confined to this embodiment.

Although the rotating member 53 of the above mentioned cassette for refixing may be rotated by an operator, it is allowed to insert a cassette for refixing 50 into the main unit, engaging it with a gear provided on the main unit and make the rotating member 53 automatically rotate so as to drop a recording sheet onto the transfer belt.

Figure 5:
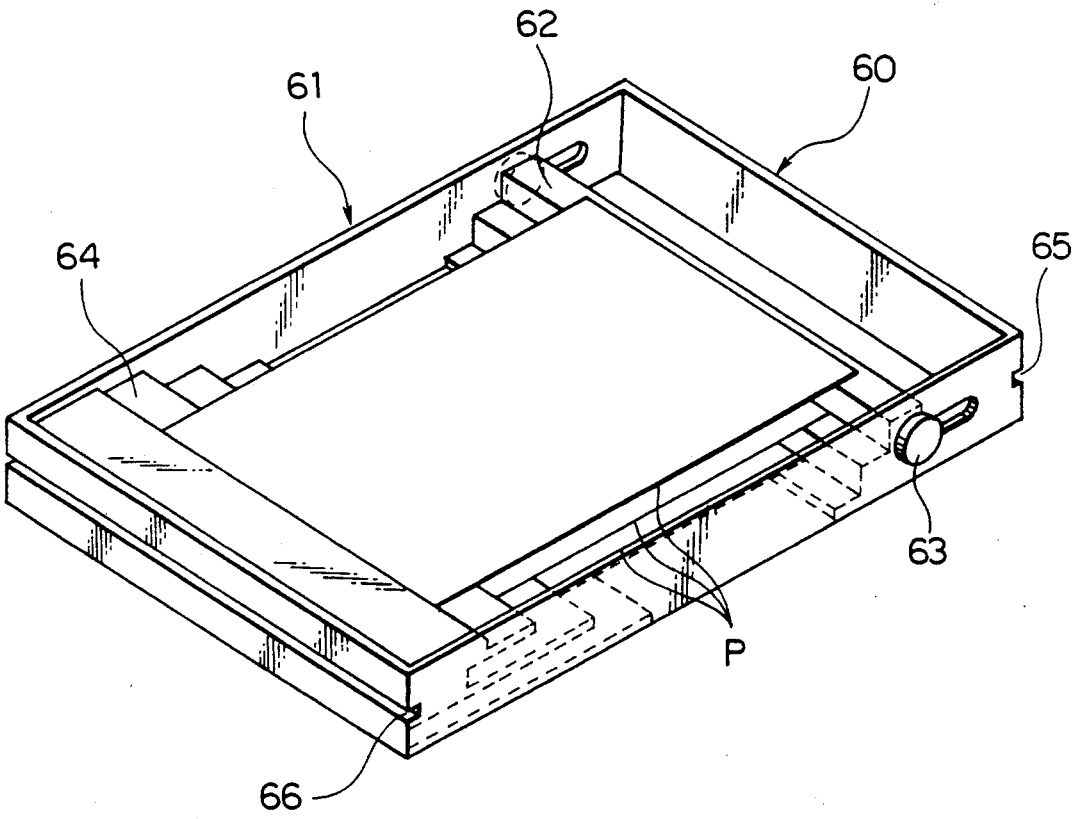
FIG. 5 is a view indicating a cassette for refixing capable of storing a plurality of recording sheets.

Although the cassette for refixing to be used may be a cassette for refixing 50 storing only one recording sheet like this embodiment, it may be a cassette for refixing 60 capable of storing multiple pieces of recording sheets as shown in FIG. 5. In the cassette for refixing 60, a movable section 62 is mounted slidably between frames 61 and both ends of the movable section 62 protruding from the frames 61 are provided with a rotating member 63 which slides together with the movable section 62. In addition, a fixed part 64 is provided on the frame 61. On the other hand, for the cassette for refixing to be attached or detached, the cassette for refixing 60 is provided with indented sections 65 and 66 corresponding to guide members 57 and 58 installed on the main unit.

This cassette for refixing 60 is inserted into the main unit like the previously mentioned cassette 50. The sliding member 63 slides the movable section 62. Then, recording sheets supported by the movable section 62 and the fixed part 64 are supplied to the transfer belt one by one.

Although, in this embodiment, the unit is turned to OHP mode by pressing the OHP button on the control panel 46, it is allowed to provide a detection means to detect that the cassette for refixing has been inserted so that the unit is automatically turned to OHP mode by a detection signal. As the detection means, conventional detection means such as a photocoupler and microswitch can be utilized.

Figure 6:
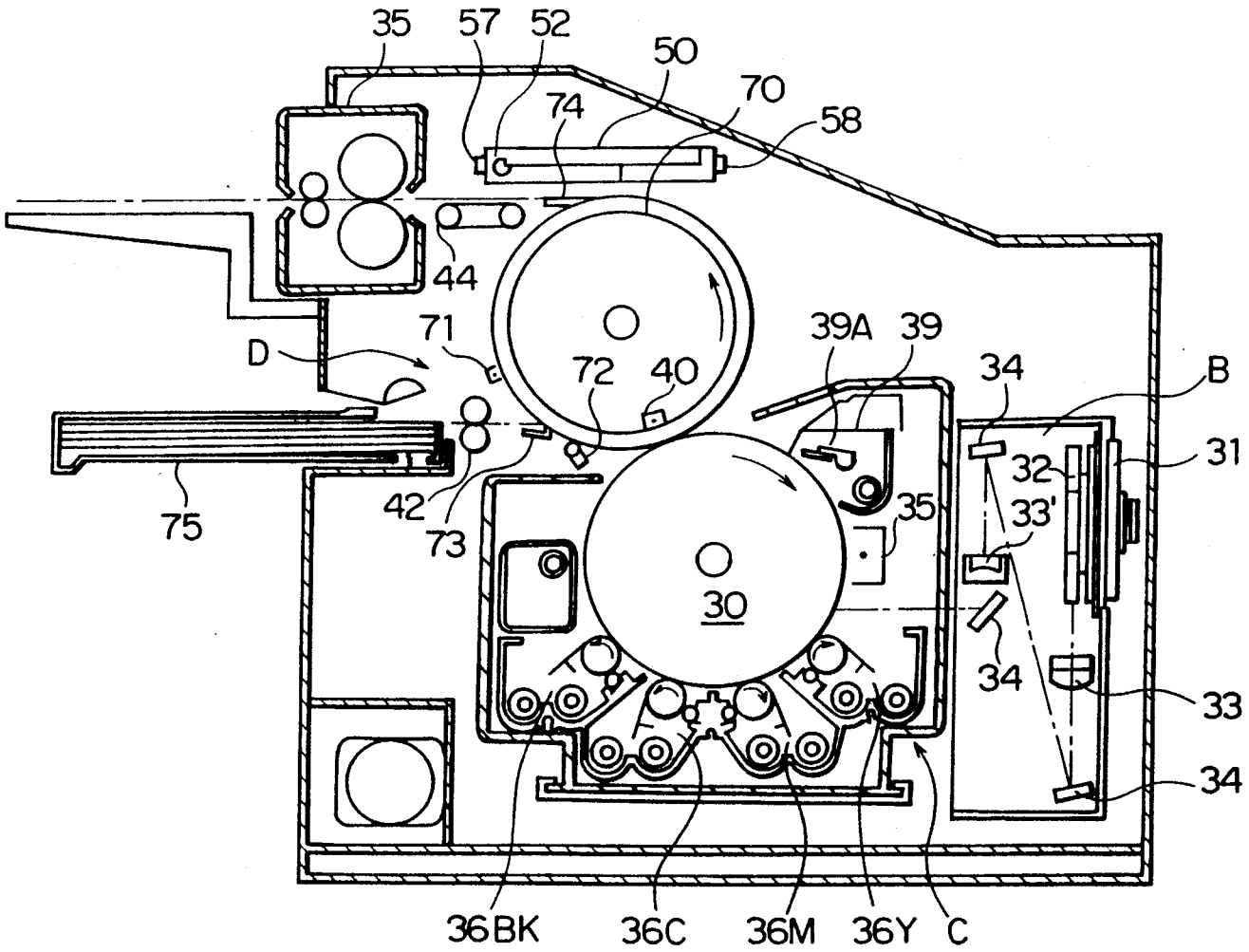
FIG. 6 is a major sectional view of a transfer drum type image forming apparatus to which the present invention is applied.

FIG. 6 shows a transfer drum type image forming device as the secondary embodiment of the present invention.

In the transfer drum type image forming device, a transfer drum 70 is in firm contact with the transfer section of an image carrying member 30 and a transfer drum 50 turns counterclockwise in synchronization with the image carrying member 30. A recording sheet is wound on the outside surface of the transfer drum 70 and each color toner image formed on the image carrying member 30 is transferred onto the wound recording sheet, so that a toner image of each color is put over other color images. After that, the recording sheet is separated from the transfer drum 70 and after those toner images are fixed, it is discharged onto the top of the main unit.

Just near the outside surface of the transfer drum 70, an electric charger 71 to attract a recording sheet with static electricity and a winding member 72 to mechanically wind a recording sheet around the transfer drum 70 are provided and the winding member 72 is equipped with a roller at its end so as to be in firm contact with the transfer drum only when a recording sheet is wound on the drum. In addition, a gripper 73 is provided on the surface of the transfer drum 70 to hold the end of a recording sheet carried in synchronization. The transfer device 40 transfers a toner image on the toner carrying member 30 onto a recording sheet through static electricity. A separation pawl 74 separates a recording sheet from the transfer drum 70 after toner images are transferred.

After being supplied from the paper feed cassette 75, a recording sheet goes into a transfer drum charged by the electric charger 71 in synchronization with a timing roller 42, and wound on the drum by means of the winding member 72 with the end of a recording sheet held by the gripper 73, so that it is turned to the transfer device, where a yellow toner image formed on the image carrying member 30 is transferred onto a recording sheet by the transfer device 40. After the initial transfer is completed, the transfer drum 70 continues to rotate so as to transfer a second toner image. That is, a magenta toner image is transferred and put over the preceding image at the second turn, followed by a cyan toner image at the third turn and then a black toner image at the fourth turn. After transfer of four color toner images is completed, the end of the recording sheet is released by the separating pawl and the recording sheet is carried to the fixing device 35 so that a toner image on the recording sheet is fixed. After that, the recording sheet is discharged out of the image forming device. The steps mentioned above are the process of image forming in ordinary mode.

Refixing using the above mentioned transfer drum type image forming apparatus is explained below.

An image is formed on a recording sheet in the above mentioned ordinary mode and a recording sheet fixed once and discharged out of the unit, is placed in the cassette for refixing 50 (60) shown in FIG. 2 or 5.

Then, the cassette for refixing 50 is set in the main unit with the indented sections 55 and 56 along the guide members 57 and 58 provided on the main unit. When the rotation member 53 of the cassette for refixing 50 is rotated, the movable section 52 is rotated so as to drop the end of a recording sheet P placed on the cutout 52A.

Now, the OHP button 47 of the control panel 46 is pressed. (See FIG. 3) When this button is pressed, OHP mode is input into the control means as shown in FIG. 4, so that drive motor speed control and fixing temperature control are output so as to delay the transfer speed of the transfer belt 44 and fixing speed of the fixing device 45 compared with the speed of normal mode and raise the fixing temperature of the fixing device 45 by 10° to 40° C. higher than normal mode.

When the fixing temperature of the fixing device 45 rises to a specified level, the drive motor rotates at the transfer speed mentioned previously according to the OHP fixing sequence so as to drive the transfer belt 44 and fixing device 45, pulling the end of the recording sheet P which has dropped on the transfer belt 44 up to the fixing device 45, where images are refixed.

Now, the present invention is explained according to the third embodiment shown in attached drawings.

Figure 7:
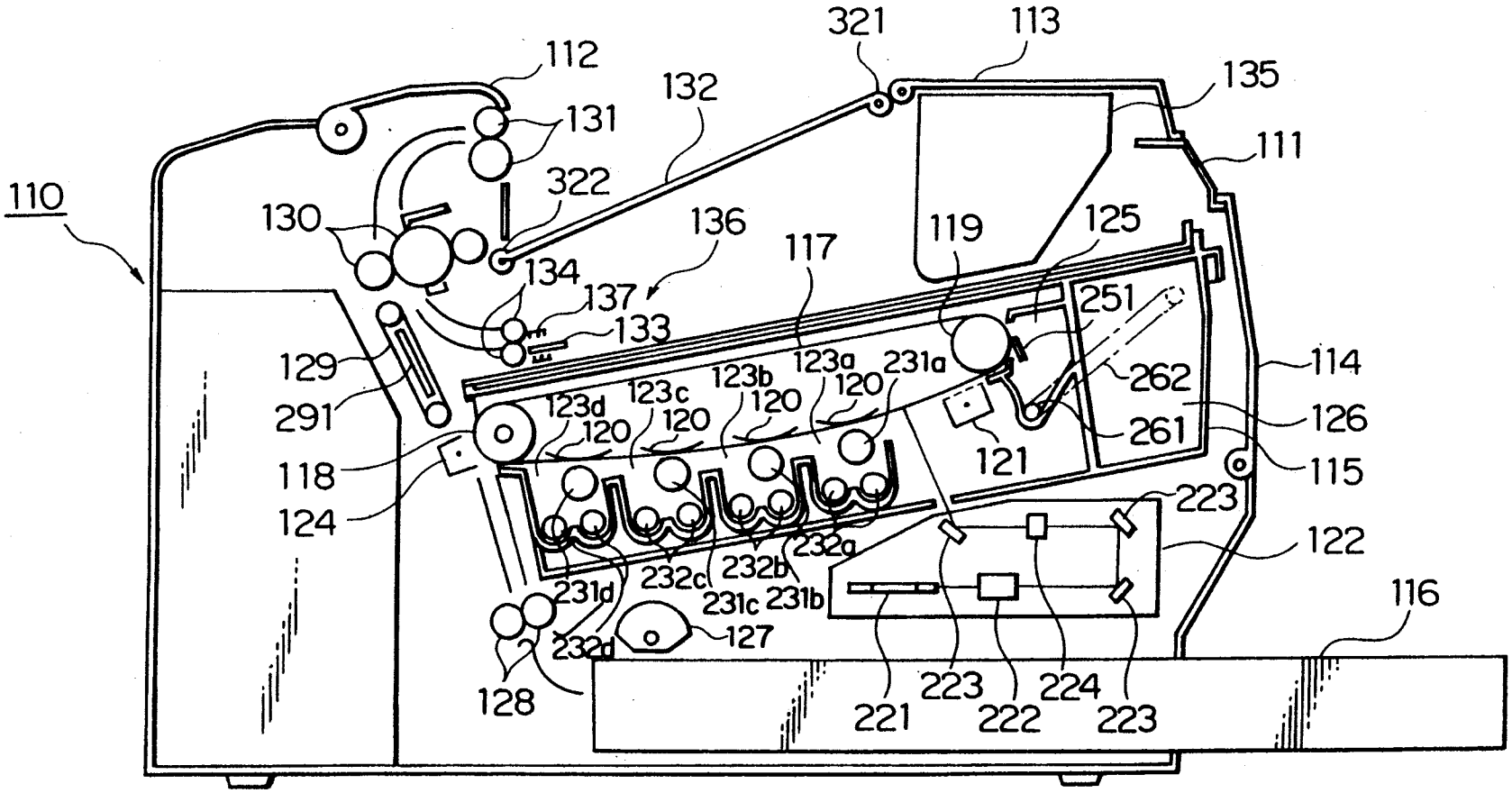
FIG. 7 is a view indicating a major left side sectional view of a color printer which is another embodiment to which the present invention is applied.

FIG. 7 shows the major cross section of the left side of the color printer of the present invention. In the main unit of the apparatus 110, the control panel 111, upper lid 112 free to open and close, toner supply cover 113, and front side cover 114 and the process cartridge 115 and paper feed cassette 116 are provided.

Referring to FIG. 7, the photoreceptor belt 117 serving as an image carrying device is coated with a photosensitive layer on the surface of a flexible belt and stretched around the drive roller 118 and driven roller 119. The drive roller 118 rotates through a drive gear which meshes with a gear provided on the main unit 110 (not shown) to convey the photoreceptor belt 117 in the clockwise direction. The distance maintaining member 120 maintains the distance between the developing device 123 and photoreceptor belt 117 constant so as to enable stabilized forming of good quality images. Although the present embodiment uses the photoreceptor belt 117 as an image carrying member, the present invention is not confined to this and applicable to existing image carrying members having a photoconductive layer such as the photoreceptor drum.

The charging means 121, exposure means 122, developing means 123, transfer means 124 and cleaning means 25 are arranged around the photoreceptor belt 117.

The charging means is provided to charge the photosensitive layer on the surface of the photoreceptor belt 117 equally with a specified polarity, and an existing charger such as a corona charger or a scorotron charger can be applied. The scorotron charger is desired for an organic photoconductive layer (OPC) photoreceptor.

The exposure means is the semiconductor laser writing system unit 122 and exposes the surface of a charge photoreceptor belt 117 to form an electrostatic latent image.

The developing means are multiple developing devices 123*a* to 123*d* containing different developers, for example, yellow, magenta, cyan and black. These developing devices 123*a* to 123*d* are equipped with developing sleeves 231*a* to 231*d* and agitation screws 232*a* to 232*d* to agitate each color toner, and have the function to develop an electrostatic latent image on the photoreceptor belt 117 to a toner image by the non-contact developing method. This non-contact developing method is different from the contact developing method, and does not damage the preceding toner image formed on the photoreceptor belt 117 or impede movement of the photoreceptor belt, thereby providing an excellent quality color picture. For developing means, besides color developing with four different colors as in the present embodiment, two or three color toners can be used, and in this case, the same number of developing devices as that of toner colors are set around the photoreceptor belt 117.

The transfer means transfers a toner image formed on the photoreceptor belt 117 onto a recording sheet by means of a transfer device 124 such as the transfer corona discharger. Existing transfer means such as a transfer drum may be used instead of the transfer device 124.

The cleaning means 125 is equipped with a cleaning blade 251 and maintained at a position apart from the surface of the photoreceptor belt 117 in the image forming process, and only at the time of cleaning after a toner image is transferred to a recording sheet, it makes contact with the surface of the photoreceptor belt 117 to clean the photoreceptor belt 117.

The toner collection box 126 collects toner left on the photoreceptor belt 117 after being cleaned by the cleaning means 125 through the toner collection pipe using the waste toner screw 261 and stores it.

In this embodiment, the photoreceptor belt 117, charger 121, developing devices 123*a*~123*d* incorporating each color toner, cleaning means 125 and toner collection box 126, which constitute the above mentioned printer image forming section, are incorporated in a single process cartridge as a unit, and can be attached to or detached from the main unit 110. However, the process sections to be incorporated in the process cartridge 115 as a unit are not limited to this structure, and the photoreceptor 117 and developing devices 123*a*~123*d* can be incorporated as a unit, and other process sections also may be combined.

The color image forming process on the color image forming apparatus having the configuration mentioned above is conducted as follows.

The process cartridge 115 is loaded at the position 1 (described later) and is able to form an image. When an image signal of the first color output from the image reader separated from the main unit 110 is input into the laser write system unit 122, the semiconductor laser (not shown) in the laser write system unit 122 generates a laser beam. The laser beam is reflected by the polygon mirror 221 which is rotated by the drive motor (not shown) and then projected on the surface of the photoreceptor belt 117 charged with a specified electric charge by the charger 121 through the $f\theta$ lens 222, cylindrical lens 224 and three mirrors 223 so as to form luminescent lines.

As for the secondary scanning direction, a belt index (not shown) corresponding to a specific position of the photoreceptor belt 117 is detected by a photo sensor (not shown) or a print instruction signal is received, and then the primary scanning line to start modulation of the semiconductor laser by an image signal is determined according to this detection or instruction signal. Concerning the primary scanning direction, when scanning starts, the laser beam is detected by the index sensor, modulation of the semiconductor laser by the image signal of the color 1 starts so that a modulated laser beam is run on the surface of the photoreceptor belt 117. Consequently, a latent image corresponding to the first color is formed on the surface of the photoreceptor belt 117 uniformly charged by the primary scanning by laser beam and secondary scanning by the conveyance of the photoreceptor belt 117. This latent image is developed by the developing device 123*a* incorporating yellow toner corresponding to the first color in the developing means and a yellow toner picture is formed on the surface of the photoreceptor belt 117. After that, the photoreceptor belt 117 passes under the cleaning blade 251 separated from the surface of the photoreceptor belt 117 while holding a yellow toner picture, followed by the start of the image forming of the second color. That is, the photoreceptor belt 117 where a yellow toner image was formed is charged uniformly by the charger 121 again and then the image signal of the second color is input into the laser write unit 122 mentioned above, so that it is written onto the photoreceptor belt 117 like the image signal of the first color mentioned previously to form a latent image. This latent image is developed as the second color by means of the developing device 123*b* containing magenta toner. This magenta toner image is formed on the already formed yellow toner image.

Likewise, a latent image of the third color is formed by the image signal and then a cyan toner image is formed by means of the developing device 123*c* containing cyan toner. Further, a latent image of the color 4 is formed by the image signal and then a black toner image is put over the already formed images on the surface of the photoreceptor belt 117 by the developing device 123*d* containing black toner, so that a color toner image is formed on the photoreceptor belt 117.

The developing sleeves 231*a* to 231*d* of these developing devices 123*a* to 123*d* are charged with DC or AC bias so as to produce a reversal (jumping) development on the photoreceptor belt 117 whose base is grounded. Meanwhile, either one-component developer or two-component developer can be utilized for this non-contact development. Although the toner hopper to be described later is unnecessary and the size can be reduced when one-component developer is used, the method using two-component developer produces better stability, therefore the latter is more favorable for reproduction of color.

A color toner image formed on the surface of the photoreceptor belt 117 as mentioned above is transferred onto a recording sheet, which is supplied from the paper feed cassette 116 by the paper feed roller 127 to the timing roller 128, by aligning the timing of the timing roller 128 with the photoreceptor belt 117. To transfer the image onto the recording sheet, the transfer device 124 is charged with a high voltage output with an opposite polarity to the toner.

After a color toner image is transferred, the recording sheet is separated from the photoreceptor belt 117, which changes its direction suddenly (small curvature) around the drive roller 118, and carried up by the transfer belt 129. Meanwhile, this carrying belt 129 is equipped with the suction means 291 and carries up the material. After fused toner is fixed to the recording sheet by the fixing roller 130, it is discharged to the top surface of the upper cover 111 serving as a paper discharge tray by the paper discharge roller 131.

On the other hand, after a transfer of a color toner picture to a recording sheet is completed, the photoreceptor belt 117 is further conveyed in the clockwise direction and then the leftover toner is removed and wiped off by the cleaning means 125 with the cleaning blade 251. After the cleaning, the cleaning blade 251 leaves the photoreceptor belt 117 again and a new image forming process is begun.

In the color image forming apparatus with the configuration mentioned above, the carrying speed of a recording sheet by the carrying means, such as the timing roller 128, photoreceptor belt 117 and carrying belt 129 at the time of image forming in ordinary mode, and the fixing speed of the fixing roller 130 and paper discharge roller 131 are 120 mm/sec, and the fixing temperature by the fixing roller 130 is 180° C.

The toner to be used for the color copier of this embodiment is polyester resin containing dissipated dye and pigment, crushed to the weight average diameter of 3 to 12 μm, whose softening point is about 140° C.

As the fixing means, the heat roller is an aluminum core coated with fluorine resin, having the diameter of about 30 mm, the pressure roller is an iron core covered with silicon rubber, having the diameter of about 30 mm, the heating lamp is a 600 W halogen lamp and the total pressure by the fixing roller 130 is 17 kg at 30 mm.

The paper discharge tray 132 which is a part of the top lid 112 mentioned above is supported rotatably on the upper lid 112 through the rotation shaft 321, free to rotate at one end, the other end latched to the cutout of the latch member 322 supported rotatably on the upper lid 112. This position of the paper discharge tray 132 (FIG. 7) is hereinafter called position 1. When the paper discharge tray 132 is located at the position 1, the paper discharge tray 132 contains a recording sheet discharged from the paper discharge roller 131.

Figure 8:
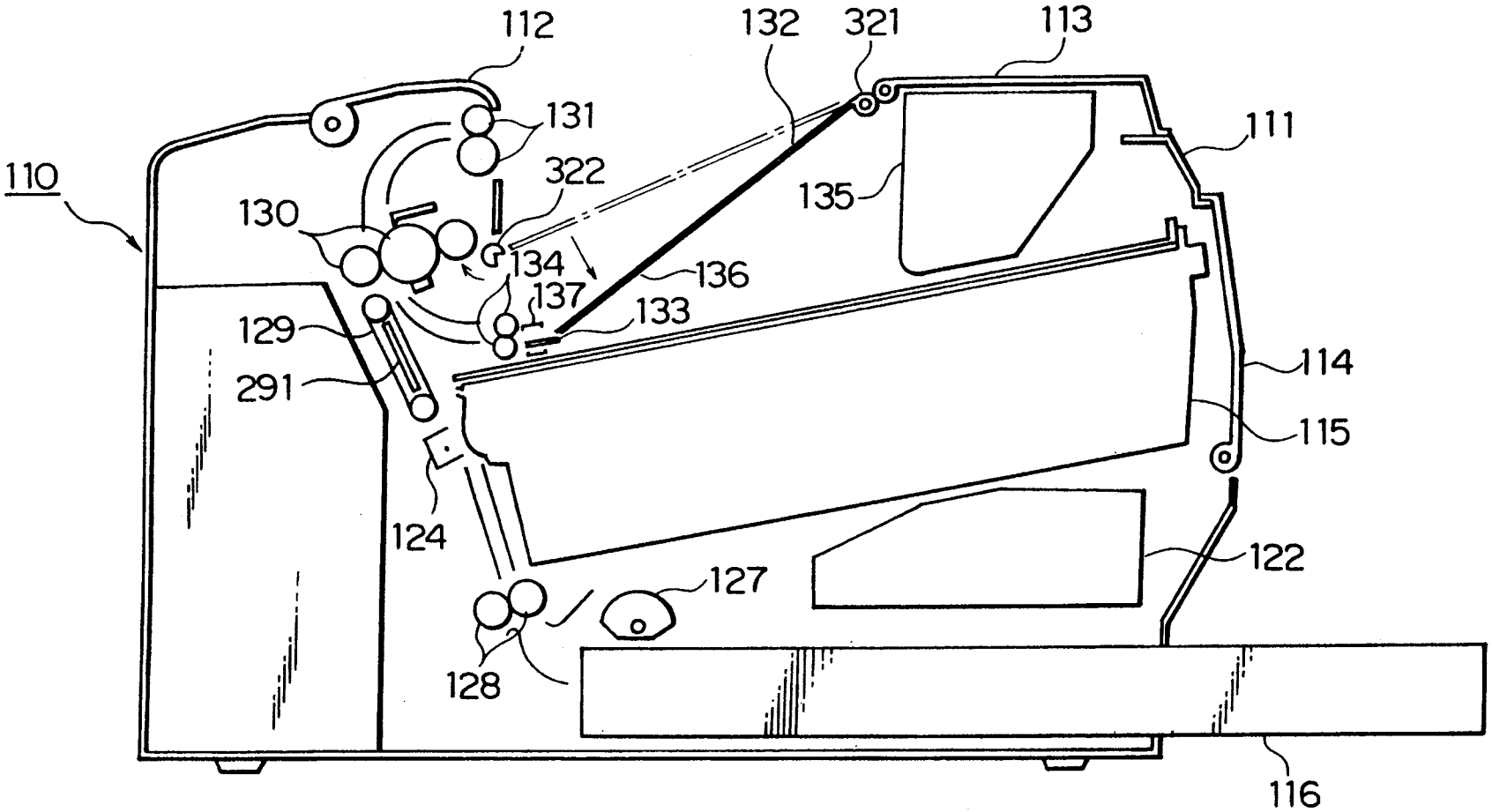
FIG. 8 is a view indicating the left side of a color printer set in refixing mode.

On the other hand, when the latch of the paper discharge tray 132 is released by rotating the latch member 322 in the arrow direction as shown in FIG. 8, the paper discharge tray 132 rotates via the rotation shaft 321 by its own weight in the arrow direction and is engaged with the positioning member 133. This position of the paper discharge tray 132 (FIG. 8) is hereinafter called the position 2. When the paper discharge tray 132 is located at the position 2, the paper discharge tray 132 serves as a paper feed tray to supply a recording sheet to the paper refeed roller 134.

The position detection sensor 136 is a sensor to detect that the paper discharge tray 132 is located at the position 2 and existing sensors such as a microswitch, photoelectric switch and magnetic switch can be used for this sensor. The recording sheet detection sensor 137 is a sensor to detect that a recording sheet to be refixed is placed on the paper discharge tray 132 located at the position 2, and existing sensors such as a transmission type or reflection type photocoupler, non-contact lead switch and contact type micro switch can be used as this sensor.

Figure 9:
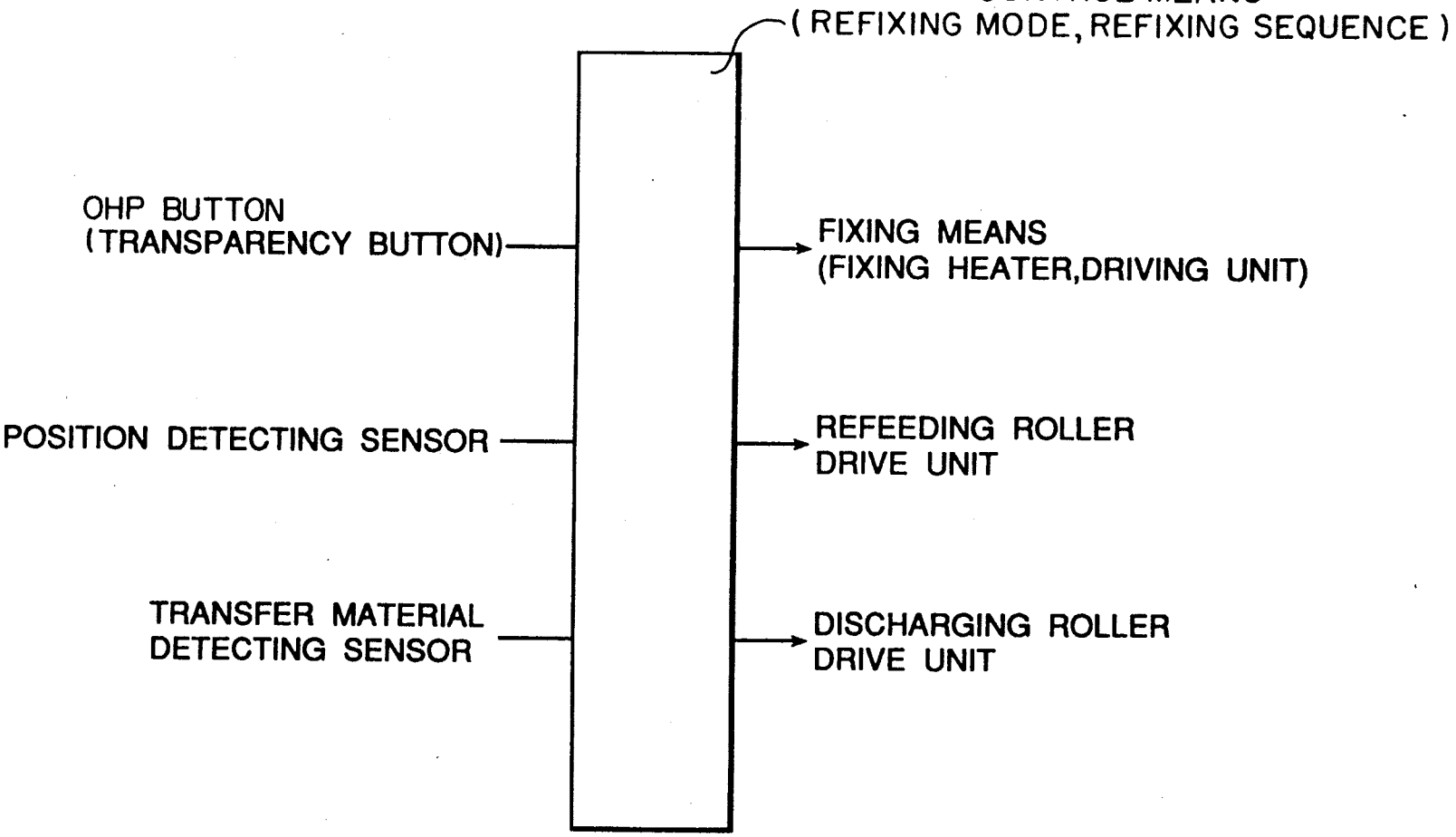
FIG. 9 is the control block diagram about refixing.

Referring to FIGS. 7–9, the process of forming a color image on a recording sheet such as OHP thick paper is as follows.

First of all, an image is formed on a recording sheet in the ordinary mode mentioned above and the recording sheet is discharged onto the paper discharge tray 132 located at the position 1, which is part of the upper lid 112.

When image forming in the ordinary mode is completed, the control means selects OHP mode by pressing the OHP button (not shown) on the control panel 111. That is, the control means controls the heater of the fixing roller 130 serving as a fixing means to raise the temperature from 180° C. under ordinary mode to 200° C. in refixing mode, and sets each drive system to reduce the carrying speed of a recording sheet by the refixing paper feed roller 134, fixing roller 130 and paper discharge roller 131 from 120 mm/sec under ordinary mode to 30 mm/sec in refixing mode.

When refixing mode is selected, the control means inactivates the image forming process including the charging means, exposure means, developing means, transfer means and cleaning means, and the carrying means including the paper feed roller 127, timing roller 128 and carrying belt 129. That is, because no image is formed at the time of refixing, the control means inactivates means necessary for image forming and activates only means necessary for refixing.

The latch member 322 is rotated to move the paper discharge tray 132 from the position 1 to the position 2. When the paper discharge tray 132 is located at the position 2 or the end of the paper discharge tray 132 collides with the positioning member 133, the position detection sensor 136 outputs a signal to the control means to indicate that the paper discharge tray 132 is located at the position 2.

Then, a recording sheet fixed once is turned over and placed on the paper discharge tray 132 located at the position 2. A recording sheet placed on the paper discharge tray 132 is detected by the recording sheet detection sensor 137, which outputs a signal to the control means. When the OHP button on the control panel 111 is pressed, the control means recognizes that the paper discharge tray 132 is located at the position 2 by means of the position detection sensor 136 and that the recording sheet to be refixed is set by means of the recording sheet detection sensor 137, so as to refix images. The control means actuates a refixing sequence by refixing mode (refixing condition) where the fixing temperature is 200° C. and the carrying speed of a recording sheet by the refeed roller 134, fixing roller 130 and paper discharge roller 131 is 30 mm/sec, supplies a recording sheet to the fixing roller 130 through the refeed roller 134 so as to refix images and then discharges the recording sheet by means of the paper discharge roller 131.

Meanwhile, the fixing temperature and carrying speed in the normal mode or refixing mode represented in this embodiment are only an example, and it is desirable that these values can be changed depending on the type of a recording sheet to be refixed and the target gloss of a finish image.

Although, in the present embodiment, the refixing sequence is started after confirming that the OHP button has been pressed, that the position of the paper discharge tray 132 has been, detected by the position detection sensor 136 and that a recording sheet has been detected by the recording sheet detection sensor 137, the refixing sequence is not confined to this, and it is allowed to select a mode or activate refixing sequence by detecting one or more of these. In this case, of the OHP button, position detection sensor 136, and recording sheet detection sensor 137, only the devices necessary for mode selection or refixing sequence need to be set on a color image forming apparatus 110.

Although the latch member 322 latching the paper discharge tray 132 can be rotated manually, it is allowed to press the OHP button for the control means to rotate the latch member 322 and move the paper discharge ray 132 to the position 2. Further, it is allowed to make the latch member 322 represented in the present embodiment unnecessary and build a gear and motor in the rotating shaft 321 of the paper discharge tray 132 to automatically move the paper discharge tray 132 from the position 1 to the position 2.

Figure 10:
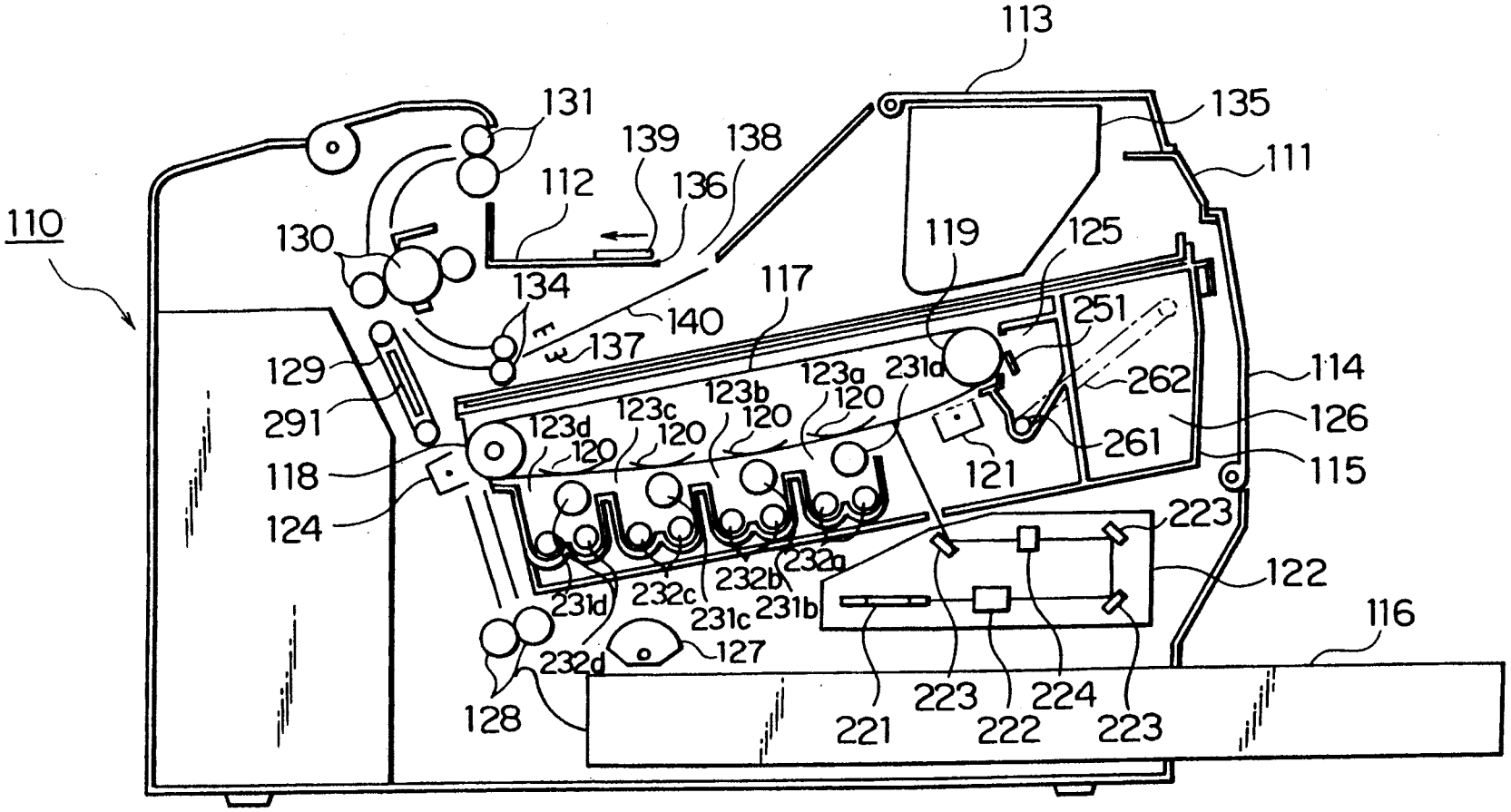
FIG. 10 is a major sectional view of a color printer of another embodiment to which the present invention is applied.

FIG. 10 shows a color image recording apparatus as the third embodiment of the present invention. Meanwhile, for numerals in the figure which indicate the same configuration and function as the color image forming apparatus of the preceding embodiment, no special comment is given.

The upper lid 112 of the present embodiment has an opening 138, and a slide cover 139 is provided as a shield member to shield the opening 138. Here, the conditions of the opening 138 being shielded by the slide cover 139 and being open are referred to as the conditions of the slide cover 139 being located at the positions 1 and 2, respectively. That is, when the slide cover 139 is located at the position 1, an image is formed in ordinary mode and when it is located at the position 2, refixing is conducted in refixing mode. The position detection sensor 136 is a sensor to detect that the slide cover 139 is located at the position 2. Meanwhile, this shield member is not confined to a slide cover 139 but may be of a door type.

On the other hand, the guide member 140 to guide a recording sheet to be refixed, the recording sheet detection sensor 137 to detect the recording sheet and the refeed roller 134 are provided below the opening 138.

Referring to FIG. 10, the process of forming a color image on a recording sheet such as OHP film and thick paper using a color copier is explained below.

First of all, an image is formed on a recording sheet in ordinary mode like the color image forming apparatus mentioned previously and the recording sheet is discharged onto the upper lid 112.

When image forming in the above mentioned ordinary mode is completed, the operator selects OHP mode as in the preceding embodiment by pressing the OHP button (not shown) on the control panel 111.

On the other hand, the slide cover 139 of the upper lid 112 is slid from the position 1 to the position 2. When the slide cover 139 is located at the position 2 or the opening 138 provided on the upper lid 112 is open, the position detection sensor 136 outputs a signal indicating that the slide cover 139 has reached the position 2 to the control means.

Now, a recording sheet fixed once is turned over and inserted into the opening 138. When the recording sheet inserted into the opening 138 is inserted further along the guide member 140, it is detected by the recording sheet detection sensor 137 and the recording sheet detection sensor 137 outputs a signal to the control means. The control means recognizes that the OHP button of the control panel 111 has been passed, and that the slide cover 139 is located at the position 2 and that the recording sheet to be refixed is set by means of the position detection sensor 136 and recording sheet detection sensor 137, respectively, before refixing an image. The control means actuates a refixing sequence by refixing mode (refixing condition) where the fixing temperature is 200° C. and the carrying speed of a recording sheet by the refeed roller 134, fixing roller 130 and paper discharge roller 131 is 30 mm/sec, supplies a recording sheet to the fixing roller 130 through the refeed roller 134 so as to refix images, and then discharges the recording sheet by means of the paper discharge roller 131.

As mentioned in detail above, the present invention provides a color image forming apparatus characterized in that an image is formed on a recording sheet such as OHP film in ordinary mode, the recording sheet fixed once is stored in the cassette for refixing and the recording sheet is carried to the fixing device again.

Consequently, the color image forming apparatus of the present invention refixes an image when fixing of color images is insufficient. When refixing, the apparatus makes yellow, magenta and cyan toners overlap completely, being mixed sufficiently at a black component image area without deteriorating image quality by decreasing the carrying speed of a recording sheet to increase the fixing temperature. In turn, this presents a color image not only well balanced with high chroma but also having an excellent gloss and optical transmission performance. In addition, when refixing mode is selected, this apparatus does not drive the image forming section and supplies a recording sheet fixed once directly to the fixing unit without making a recording sheet to be refixed come into contact with the image carrying member or damaging the image carrying member. Further, the present invention can provide an image forming apparatus which can refix images through a simple mechanism without a special carrying path, by using a refixing cassette, despite small size.

Still further, the present invention relates to a color image forming apparatus which carries back a recording sheet, such as OHP film fixed once, to the fixing device again after an image is formed in ordinary mode.

The present invention also provides such an effect that not only the size of the image forming apparatus can be reduced because of a loop structure making the paper discharge tray serve as a paper feed tray for refixing, but also an image forming apparatus capable of refixing images can be presented through a simple mechanism where only a guide and refeed roller are provided on the carrying path for refixing.

What is claimed is:

1. A color image forming apparatus comprising:
(A) an image carrying member on which a toner image may be formed;
(b) means for transferring the toner image onto a recording sheet;
(c) means for conveying the recording sheet on which the toner image has been transferred along a conveyance path for at least an initial image fixing;
(d) means for fixing the toner image on the recording sheet; and
(e) means for feeding the recording sheet, which has been subject to the initial image fixing, to the conveying means at a location downstream of both said image carrying member and said transferring means to enable at least a second image fixing of the recording sheet by said fixing means, the feeding means including means for storing at least one recording sheet.

2. The apparatus of claim 1, wherein said storing means is detachably mountable to said apparatus.

3. The apparatus of claim 1, further comprising control means for controlling the conditions under which fixing occurs by the fixing means so that difference fixing conditions may be set for the initial image fixing and the second image fixing.

4. A color image forming apparatus having image transferring means comprising:
(a) means for fixing a toner image on a recording sheet;
(b) storage means, movable between a first position and a second position, for storing a discharged recording sheet from said fixing means when in the first position; and
(c) feed means for feeding the discharged recording sheet which has been once subject to said fixing means to a location downstream of the image transferring means for fixing the recording sheet at least a second time by the fixing means, said feed means operable when said storage means takes the second position.

5. The apparatus of claim 4, further comprising control means for controlling the fixing conditions of the fixing means to change the fixing conditions when said storage means takes the second position.

6. A color image forming apparatus comprising:
(a) means for fixing a toner image on a recording sheet, said fixing means fixing said image at least a first time;
(b) storage means for storing a discharged recording sheet from said fixing means, said storage means having an opening through which the discharged recording sheet can be inserted into said apparatus; and
(c) feed means for feeding the recording sheet inserted through said opening to a location downstream of an image carrying member and transferring means for the recording sheet to be fixed at least a second time by the fixing means.

7. The apparatus of claim 6, further comprising a member for shielding said opening.

8. The apparatus of claim 6, further comprising control means for controlling the conditions under which fixing occurs so that different conditions may be set for fixing the recording sheet the first time and the second time.

9. The apparatus of claim 1, further comprising control means for inhibiting an image forming process when said fixing means is fixing the recording sheet for the second image fixing.

10. The apparatus of claim 1, further comprising:
(a) means for enabling selection by an operator of a transparent film mode from a plurality of modes; and
(b) control means for activating said feeding means in response to a signal output from said selection enabling means, so that when the transparent film mode is selected, said feeding means feeds the recording sheet to said downstream location.

11. The apparatus of claim 1, wherein said feeding means comprises a rotating member for feeding the recording sheet having the initial image from said storing means to said downstream location.

12. The apparatus of claim 4, further comprising control means for inhibiting an image forming process when said fixing means fixes the recording sheet the second time.

13. The apparatus of claim 4, further comprising:
(a) means for enabling selection by an operator of a transparent film mode from a plurality of modes; and
(b) control means for moving said storage means in response to a signal output from said selection enabling means, so that when the transparent film mode is selected, said storage means is moved from the first position to the second position.

14. The apparatus of claim 4, further comprising a sensor for detecting the recording sheet to be fixed the second time on said storage means located in the second position, wherein said sensor includes means for outputting a signal to begin a refixing sequence.

15. The apparatus of claim 4, wherein said feed means comprises a refeed roller for carrying the discharged recording sheet from the storage means to said downstream location.

16. The apparatus of claim 6, further comprising control means for inhibiting an image forming process when said fixing means fixes the recording sheet the second time.

17. The apparatus of claim 6, wherein said feeding means comprises a refeed roller for carrying the discharged recording sheet to said downstream location.

18. The apparatus of claim 7, further comprising:

(a) means for enabling selection by an operator of a transparent film mode from a plurality of modes; and (b) control means for moving said shielding member in response to a signal output from said selection enabling means, so that when the transparent film mode is selected, said shielding member is moved from a closed state to an open state.

19. The apparatus of claim 7, further comprising a sensor for detecting the recording sheet to be fixed the second time in said storage means when said shielding member is not shielding the opening, said sensor including means for outputting a signal to begin a refixing sequence.

* * * * *

UNITED STATES PATENT AND TRADEMARK OFFICE

CERTIFICATE OF CORRECTION

PATENT NO. : 5,239,348

DATED : August 24, 1993

INVENTOR(S) : Masakazu Fukuchi et al.

It is certified that error appears in the above-indentified patent and that said Letters Patent is hereby corrected as shown below:

Claim 3, column 13, line 53, change "difference" to --different--.

Signed and Sealed this

Twelfth Day of July, 1994

Bruce Lehman

*Attest:*

BRUCE LEHMAN

*Attesting Officer*

*Commissioner of Patents and Trademarks*